United States Patent [19]

Abe et al.

[11] Patent Number: 5,070,756

[45] Date of Patent: Dec. 10, 1991

[54] ENSEMBLE TONE COLOR GENERATOR FOR AN ELECTRONIC MUSICAL INSTRUMENT

[75] Inventors: Yasunao Abe; Shoji Tokunaga; Kotaro Mizuno, all of Hamamatsu, Japan

[73] Assignee: Yamaha Corporation, Hamamatsu, Japan

[21] Appl. No.: 455,599

[22] Filed: Dec. 21, 1989

[30] Foreign Application Priority Data

Dec. 26, 1988 [JP] Japan ..... 63-328750

[51] Int. Cl.[5] ..... G10H 1/36

[52] U.S. Cl. ..... 84/618; 84/625; 84/631; 84/656; 84/664; 84/DIG. 4

[58] Field of Search ..... 84/623, 626, 627, 631, 84/645, 664, DIG. 9, DIG. 4, 615, 618, 620, 622, 653, 656, 659

[56] References Cited

U.S. PATENT DOCUMENTS

| | | | |
|---|---|---|---|
| 4,223,584 | 9/1980 | Nakada et al. | 84/617 |
| 4,387,617 | 6/1983 | Kato et al. | 84/615 |
| 4,628,789 | 12/1986 | Fujimori | 84/631 X |
| 4,633,749 | 1/1987 | Fujimori et al. | 84/607 |
| 4,711,148 | 12/1987 | Takeda et al. | 84/645 X |
| 4,738,179 | 4/1988 | Hideo | 84/623 X |
| 4,827,547 | 5/1989 | Deutsch | 84/631 |
| 4,887,503 | 12/1989 | Suzuki | 84/613 |
| 4,907,484 | 3/1990 | Suzuki et al. | 84/622 X |
| 4,922,795 | 5/1990 | Suzuki | 84/623 X |
| 4,957,552 | 9/1990 | Iwase | 84/631 X |

FOREIGN PATENT DOCUMENTS

| | | |
|---|---|---|
| 59-39756 | 9/1984 | Japan . |
| 61-18756 | 5/1986 | Japan . |
| 62-52316 | 11/1987 | Japan . |

*Primary Examiner*—William M. Shoop, Jr.
*Assistant Examiner*—Brian Sircus
*Attorney, Agent, or Firm*—Spensley Horn Jubas & Lubitz

[57] ABSTRACT

An electronic musical instrument having a key-depression-detecting circuit for detecting a depressed key on a keyboard and for generating tone-pitch data corresponding to the depressed key, a tone-color-designating circuit for sequentially designating a desired tone color among a plurality of tone colors, a tone-color-data-storing circuit for storing tone-color data associated with the tone colors sequentially designated by the tone-color-designating circuit, an ensemble-tone-designating circuit for designating a predetermined number of tone colors among the most recently designated tone-color data stored in the tone-color-data-storing circuit; and a musical-tone-signal-generating circuit for generating a plurality of musical-tone signals in a parallel fashion, each of the musical-tone signals having a tone color corresponding to one of the tone colors designated by the ensemble-tone-designating circuit, and having a tone-pitch corresponding to the tone-pitch data generated by the key-depression-detecting circuit. The invention facilitates the selection of a desired combination of instrument sounds in an ensemble as well as changing the combination.

10 Claims, 1 Drawing Sheet

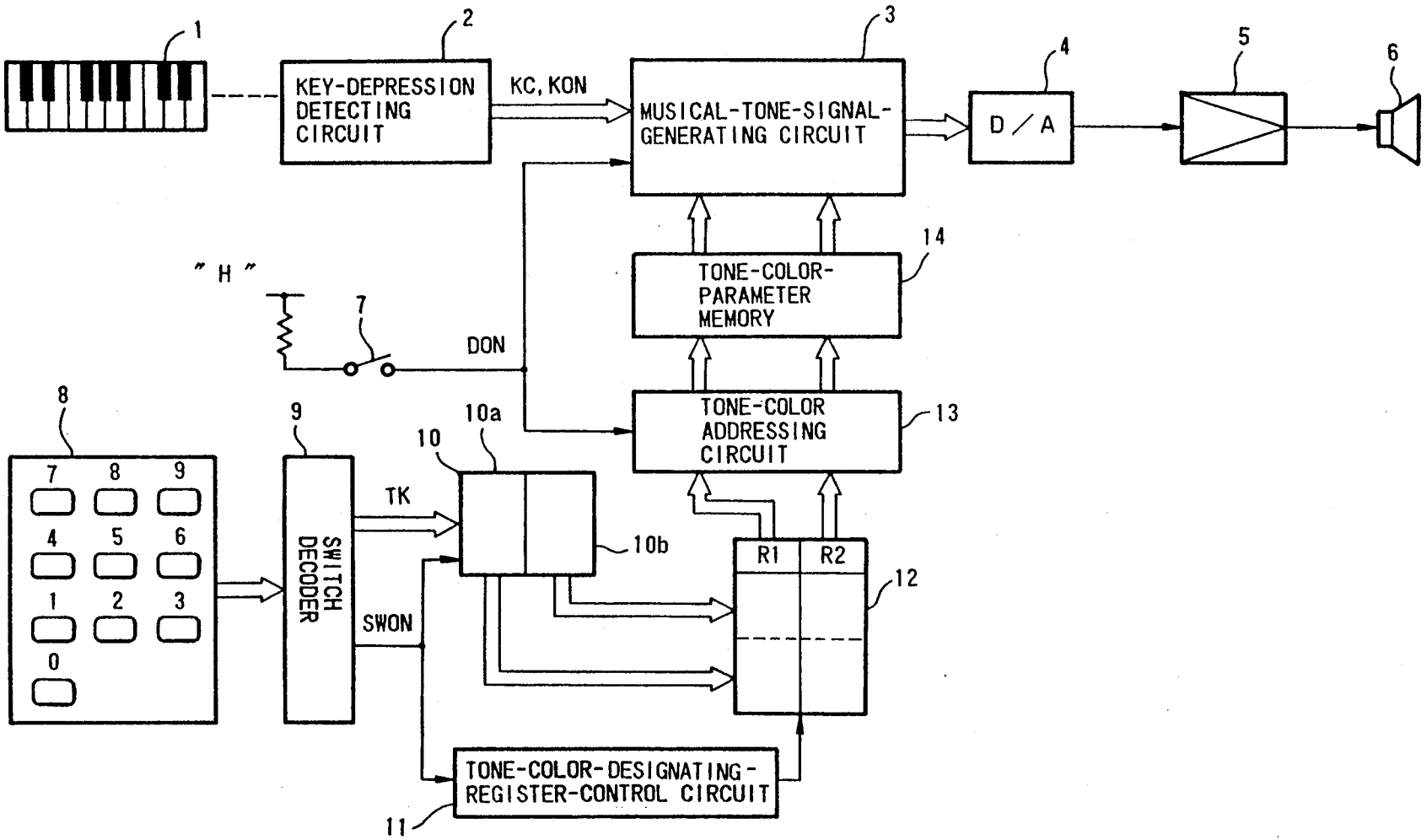
FIG. 1 EMBODIMENT

ENSEMBLE TONE COLOR GENERATOR FOR AN ELECTRONIC MUSICAL INSTRUMENT

BACKGROUND OF THE INVENTION

1. Field of the Invention

The present invention relates to an electronic musical instrument that can simulate the performance of an ensemble by generating a plurality of tone colors in response to a key operation.

2. Prior Art

Electronic musical instruments that can synthesize musical tones such as piano tones by using digital LSI (Large-Scale-Integration) and other components have been developed. These types of conventional musical instruments generally have a depressed-key-detecting circuit and a musical-tone-signal-generating circuit. The depressed-key-detecting circuit scans a keyboard to detect a depressed key, and generates a keycode representing the tone pitch associated with the depressed key. The musical-tone-signal-generating circuit generates musical-tone signals corresponding to the tone pitch and having a tone color preset by a tone-color-setting switch. The musical-tone signals thus generated are amplified by an amplifier, and musical tones corresponding to the musical-tone signals are produced from a speaker.

In addition to the instruments described above, some instruments which can simulate the performance of an ensemble have been developed. These instruments have musical-tone-signal-generating circuits that can generate a plurality of musical-tone signals of different tone colors, such as those of a piano and a violin, in response to a key operation, thus generating a combination of musical tones of different tone colors.

There are two types of these conventional instruments:

(1) In the first type of conventional instrument, the combination of ensemble tones, such as piano and violin, or organ and flute, is determined and prestored in ROM in the fabrication process. Hence, a performer can merely select one of these combinations before or during performance. (2) In the second type of conventional instrument, a plurality of musical-tone-signal-generating channels are provided, and each tone color is assigned to one of the musical-tone-signal-generating channels.

These instruments, however, present the following problems:

In the first type of instrument above, a combination other than the combinations set in the fabrication process cannot be selected, thus restricting the freedom of choice of the combinations of ensemble tone colors.

In the second type of instrument above, a tedious operation is required to assign combinations of tone colors to the channels, making it difficult to change combinations during performance.

SUMMARY OF THE INVENTION

It is therefore an object of the present invention to provide an electronic musical instrument in which a performer can freely set the combination of ensemble tones according to the performer's intention.

It is another object of the present invention to provide an electronic musical instrument in which a performer can change the combination of ensemble tones by a simple operation.

In one aspect of the present invention, there is provided an electronic musical instrument comprising:

key-depression-detecting means for detecting a depressed key on a keyboard, and for generating tone-pitch data corresponding to the depressed key;

tone-color-designating means for sequentially designating a desired tone color among a plurality of tone colors;

tone-color-data-storing means for storing tone-color data associated with the tone colors sequentially designated by the tone-color-designating means, the tone-color data being stored according to the sequence of designation;

ensemble-tone-designating means for designating a predetermined number of tone colors among the most recently designated tone-color data stored in the tone-color-data-storing means; and musical-tone-signal-generating means for generating a plurality of musical-tone signals in a parallel fashion, each of the musical-tone signals having a tone color corresponding to one of the tone colors designated by the ensemble-tone-designating means, and having a tone-pitch corresponding to the tone-pitch data generated by the key-depression-detecting means.

In another aspect of the present invention, there is provided an electronic musical instrument comprising:

key-depression-detecting means for generating tone-pitch information corresponding to a depressed key within plural keys provided in a keyboard;

tone-color-designating means for sequentially designating desirable tone colors selected from plural tone colors;

tone-color-data-storing means for storing a predetermined number of tone-color data including lastly designated tone-color data in a predetermined order;

ensemble-tone-designating means for designating generation of an ensemble-tone; and musical-tone-signal-generating means for simultaneously generating plural musical-tone signals having a tone-pitch corresponding to the tone-pitch information and also having tone colors corresponding to plural tone-color data read from the tone-color-data-storing means.

BRIEF DESCRIPTION OF THE DRAWINGS

FIG. 1 is a block diagram showing the configuration of an embodiment of the electronic musical instrument of the present invention.

DESCRIPTION OF THE PREFERRED EMBODIMENTS

The invention will now be described with reference to the accompanying drawings.

FIG. 1 is a block diagram showing the configuration of an embodiment of the electronic musical instrument of the present invention. In FIG. 1, numeral 1 designates a keyboard having a plurality of keys, numeral 2 designates a key-depression-detecting circuit. Each key of keyboard 1 is provided with a key-switch that turns on when the key is depressed and turns off when the key is released. Key-depression-detecting circuit 2 scans the key-switches to detect the ON/OFF state of each key, and outputs keycode KC representing the depressed key, and key-on signal KON representing the timing of the key depression. The keycode KC and the key-on signal KON are supplied to musical-tone-signal-generating circuit 3. Musical-tone-signal-generating circuit 3 generates musical-tone signals (digital signals)

of the tone pitches corresponding to the keycode KC on the basis of the keycode KC and key-on signal KON. The musical-tone signals generated by musical-tone-signal-generating circuit 3 are a pair of digital signals of different tone colors generated in a parallel fashion during an ensemble-designating signal DON is supplied. The pair of musical-tone signals is synthesized into a digital musical-tone signal, and the synthesized musical-tone signal is outputted from musical-tone-signal-generating circuit 3. The tone colors of the pair of musical-tone signals are specified by a pair of tone-color parameters fed from tone-color-parameter memory 14. The digital musical-tone signals outputted from musical-tone-signal-generating circuit 3 are converted into analog musical-tone signals by D/A convertor 4. The output of D/A converter 4 is amplified by amplifier 5, and produced from speaker 6 as musical tones.

One end of ensemble-designating switch 7 is connected to a high-level voltage "H" through a resistor, and the other end is connected to musical-tone-signal-generating circuit 3 and tone-color addressing circuit 13, so that high-level voltage ensemble-designating signal DON is supplied to the circuits 3 and 13 when the switch 7 is in the ON state. Tone-color-designating-numerical keypad 8 is provided for entering a tone-color code of two-digits, which is assigned to each tone color. A performer can select a desired tone color by entering a two-digit tone-color code from keypad 8. For example, when designating the tone color of a piano, the performer enters "23" , whereas when designating that of an organ, the performer enters "09" . When entering the tone-color code, the performer first looks for the tone-color code assigned to a desired tone color in a tone-color list (not shown), then enters the tone-color code. An on/off signal of each key of numerical keypad 8 is supplied to switch decoder 9 which generates switch data TK represented in BCD (Binary-Coded Decimal). Switch decoder 9 generates a switch-on signal SWON in conjunction with switch data TK which represents the depressed key each time a key of keypad 8 is depressed. Switch data TK is supplied to switch-data buffer 1O, and switch-on signal SWON is supplied to tone-color-designating-register-control circuit 11 as well as switch-data buffer 10. Switch-data buffer 10 consists of a first-stage register 1O*a* and a second-stage register 1O*b*, and temporarily stores two-digit switch data TK. When switch-on-detecting signal SWON occurs, first-stage register 1O*a* loads a new switch data TK, and simultaneously transfers switch data TK stored in first-stage register 1O*a* to second-stage register 1O*b*. Switch data TK of two-digits thus stored in switch-data buffer 10, i.e., the tone-color code designated by the performer is supplied to tone-color-designating register 12. On the other hand, tone-color-designating-register-control circuit 11, commands tone-color-designating register 12 to load the tone-color code each time two-digit code is entered by numerical keypad 8, i.e., each time switch-on signal SWON occurs twice. Tone-color-designating-register 12 has 2-stage registers R1 and R2 so that two tone-color codes can be stored sequentially. Each time a command to load a tone-color code is sent from tone-color-designating-register-control circuit 11, tone-color-designating-register 12 loads a new tone-color code into first-stage register R1, and simultaneously transfers the tone-color code stored in first-stage register R1 into second-stage register R2. Hence, each time the performer enters a two-digit tone-color code by numerical keypad 8, the current tone-color code is entered into first-stage register R1 and the previous tone-color code is entered into second-stage register R2. The two tone-color codes thus entered into tone-color-designating register 12 are supplied to tone-color addressing circuit 13 and are converted into address signals corresponding thereto. Tone-color addressing circuit 13 produces two address signals corresponding to the two tone-color codes in registers R1 and R2 when ensemble-designating signal DON is supplied via ensemble-designating switch 7. In contrast, when the ensemble-designating signal is not supplied, tone-color addressing circuit 13 produces only one address signal corresponding to the tone-color code in register R1. These address signals (or signal) are supplied to tone-color-parameter memory 14. Tone-color-parameter memory 14 stores a number of musical-tone parameters necessary for generating musical-tone signals in musical-tone-signal-generating circuit 3 according to the types of tone colors, and reads tone-color parameters designated by one or two address signals supplied from tone-color addressing circuit 13. The tone-color parameters read are then supplied to musical-tone-signal-generating circuit 3.

The operation of the embodiment will now be described.

When, for example, the tone-color code "23" of a piano tone color is entered from tone-color-designating-numerical keypad 8, the tone-color code "23" is written into first-stage register R1 of tone-color-designating register 12 via switch-data buffer 1O. Subsequently, when the tone-color code "09" of an organ tone color is entered from numerical keypad 8, the tone-color code "09" is written into first-stage register R1, and simultaneously the tone-color code "23" previously stored in register R1 is transferred into second-stage register R2.

When ensemble-designating switch 7 is in the ON state, the two series of musical-tone signals of a piano and an organ are generated in a parallel fashion and are combined into a single series of musical-tone signals: first, address-signals each of which corresponds to tone-color codes "09" and "23" stored in registers R1 and R2, respectively, are supplied to tone-color-parameter memory 14 via tone-color addressing circuit 13 when ensemble-designating signal DON is supplied to tone-color addressing circuit 13; second, the musical-tone parameters corresponding to tone-color codes "09" and "23" are supplied from tone-color-parameter memory 14 to musical-tone-signal-generating circuit 3; third, musical-tone-signal-generating circuit 3 generates two types of musical-tone signals corresponding to tone-color codes "09" (organ) and "23" (piano) in a parallel fashion; and finally, the two series of musical-tone signals are combined into a single series of musical-tone signals and the ensemble tones of a piano and an organ are produced from speaker 6. In this case, the above musical-tone signals generated by musical-tone-signal-generating circuit 3 are produced on the basis of keycodes KC and key-on signal KON supplied from key-depression-detecting circuit 2, and have tone-pitches corresponding to keycodes KC and tone colors corresponding to tone-color codes "08" and "23" supplied from tone-color-parameter memory 14. Thus, when ensemble-designating switch 7 is in the 0N state, ensemble tones of two tone colors are generated, each of the tone colors is designated by the latest operation and the previous operation of tone-color-designating-numerical keypad 8. Hence, the combination of ensemble tones can be freely changed by operating tone-color-designating-numerical keypad 8.

On the other hand, when ensemble-designating switch 7 is in the OFF state, a series of musical-tone signals (of an organ, for example) is generated and produced from speaker 6: first, address-signal corresponding to tone-color code "09" (organ) stored in register R1 is supplied to tone-color-parameter memory 14 via tone-color addressing circuit 13 when ensemble-designating signal DON is not supplied to tone-color addressing circuit 13; second, the musical-tone parameters corresponding to the tone-color code "09" are supplied from tone-color-parameter memory 14 to musical-tone-signal-generating circuit 3; third, musical-tone-signal-generating circuit 3 generates musical-tone signals corresponding to tone-color code "09" (organ); and finally, musical-tone signals of an organ are produced from speaker 6. In this case, the above musical-tone signals generated by musical-tone-signal-generating circuit 3 are produced on the basis of keycodes KC and key-on signal KON supplied from key-depression-detecting circuit 2, and have tone-pitches corresponding to keycodes KC and a tone color specified by the tone-color code "09" supplied from tone-color-parameter memory 14. Thus, when ensemble-designating switch 7 is in the OFF state, musical tones of the tone color designated by the latest operation of tone-color-designating-numerical keypad 8 are generated. Hence, the tone color can be freely changed by operating tone-color-designating-numerical keypad 8.

Although a specific embodiment of an electronic musical instrument constructed in accordance with the present invention has been disclosed, it is not intended that the invention be restricted to either the specific configurations or the uses disclosed herein. Modifications may be made in a manner obvious to those skilled in the art. For example:

(1) The number of stages of tone-color-designating register 12, and the number of ensemble tones of musical-tone-signal-generating circuit 3 can be increased, thereby increasing the number of tones which may be played simultaneously.

(2) In the case where the number of tones of the ensemble is increased to more than two as in (1) above, it is possible to increase the number of tone colors of ensemble tones one by one each time ensemble-designating switch 7 is depressed, such as mono-tone color, two-tone colors, three-tone colors, etc.

(3) The pitches of musical-tone signals of a plurality of tone colors generated by musical-tone-signal-generating circuit 3 can be slightly differentiated so that greater ensemble effect can be achieved.

(4) A tone-color-parameter-modification circuit for modifying the tone-color parameters fed from tone-color-parameter memory 14 to musical-tone-signal-generating circuit 3 can be provided so as to change some of the tone-color parameters or all of the tone-color parameters.

(5) An envelope-generating circuit for providing fade-in effect or fade-out effects for the musical-tone signals generated by musical-tone-signal-generating circuit 3 can be included in musical-tone-signal-generating circuit 3. The envelope-generating circuit is triggered by the ON/OFF signals fed from ensemble-designating switch 7, and gradually increases the tone volumes of superposed tones (fade-in effect) when ensemble-designating switch 7 is turned on, or gradually decreases the tone volumes of superposed tones (fade-out effect) when ensemble-designating switch 7 is turned off.

(6) Musical-tone-signal-generating circuit of the type that processes the spectrum of a waveform by means of filters to generate various tone colors can be used. In this case, parameters of the filters can be sequentially changed to predetermined values when the ensemble-designating switch is turned on so that the ensemble tone colors gradually change to the intended tone colors.

(7) A series of processes carried out by means of switch decoder 9, switch-data buffer 10, tone-color-designating-register-control circuit 11, and tone-color-designating register 12 of the above embodiment can be accomplished by means of software in conjunction with a microcomputer.

Accordingly, it is intended that the invention be limited only by the scope of the appended claims.

What is claimed is:

1. An electronic musical instrument comprising:

key-depression-detecting means for detecting a depressed key on a keyboard, and for generating tone-pitch data corresponding to the depressed key;

tone-color-designating means for sequentially designating a desired tone color among a plurality of tone colors;

tone-color-data-storing means for storing tone-color data associated with said tone colors sequentially designated by said tone-color-designating means, said tone-color data being stored according to the sequence of designation;

ensemble-tone-designating means for designating a predetermined number of tone colors among the most recently designated tone-color data stored in said tone-color-data-storing means; and musical-tone-signal-generating means for generating a plurality of musical-tone signals in a parallel fashion, each of said musical-tone signals having a tone color corresponding to one of said tone colors designated by said ensemble-tone-designating means, and having a tone-pitch corresponding to said tone-pitch data generated by said key-depression-detecting means.

2. An electronic musical instrument according to claim 1, wherein said tone-color-data-storing means has a two or more stage registers for storing two or more sets of said tone color data.

3. An electronic musical instrument according to claim 1, wherein said musical-tone-signal-generating means has two or more channels for generating musical tones of the tone colors designated by said ensemble-tone-designating means.

4. An electronic musical instrument according to claim 1, wherein said ensemble-tone-designating means increases the number of tone colors of ensemble tones one by one each time said tone-color-designating means is operated.

5. An electronic musical instrument according to claim 1, wherein said musical-tone-signal-generating means generates musical-tone signals of a plurality of tone colors, said musical-tone signals having slightly different tone pitches.

6. An electronic musical instrument according to claim 1 further comprising a tone-color-parameter-modification means for modifying the tone-color data fed from said tone-color-data-storing means to said musical-tone-signal-generating means so as to change a part of the tone-color data or all of the tone-color data.

7. An electronic musical instrument according to claim 1 further comprising an envelope-generating means for providing fade-in effect or fade-out effects for the musical-tone signals generated by the musical-tone-signal-generating means.

8. An electronic musical instrument according to claim 7, wherein ensemble-tone-designating means provides ON/OFF signals to control said designation and wherein said envelope-generating means is triggered by the ON/OFF signals fed from said ensemble-tone-designating means, and increases the tone volumes of ensemble tones when the ensemble-tone-designating means is turned on, or decreases the tone volumes of superposed tones when the ensemble-tone-designating means is turned off.

9. An electronic musical instrument according to claim 1, wherein the musical-tone-signal-generating means is of the type that processes the spectrum of a waveform by means of filters to generate various tone colors, and parameters of said filters can be incrementally changed to predetermined values when ensemble-tone-designating means is turned on so that the ensemble tone colors gradually change to the intended tone colors.

10. An electronic musical instruments comprising:

key-depression-detecting means for generating tone-pitch information;

tone-color-designating means for sequentially designating desirable tone colors selected from plural tone colors;

tone-color-data-storing means for storing a predetermined number of tone-color-data including last designated tone-color-data in a predetermined order;

ensemble-tone-designating means for designating generation of an ensemble-tone; and musical-tone-signal-generating means for simultaneously generating plural muscial-tone signals having atone-pitch corresponding to said tone-pitch information and also having tone colors corresponding to plural tone-color-data read from said tone-color-data-storing means.

* * * * *